United States Patent [19]

Günther et al.

[11] 4,392,470

[45] Jul. 12, 1983

[54] TEMPERATURE RESPONSIVE OPEN/CLOSED LOOP SWITCHING FOR LAMBDA CONTROL

[75] Inventors: Dieter Günther, Murr; Richard Bertsch, Asperg; Siegfried Böttcher, Remseck; Herbert Arnold, Eberdingen; Hans Schnürle, Walheim; Michael Horbelt, Schwieberdingen, all of Fed. Rep. of Germany

[73] Assignee: Robert Bosch GmbH, Stuttgart, Fed. Rep. of Germany

[21] Appl. No.: 276,757

[22] Filed: Jun. 24, 1981

[30] Foreign Application Priority Data

Jun. 28, 1980 [DE] Fed. Rep. of Germany ..... 3024606

[51] Int. Cl.[3] ..... F02B 33/00

[52] U.S. Cl. ..... 123/440

[58] Field of Search ..... 123/440; 60/276, 285

[56] References Cited

U.S. PATENT DOCUMENTS

| | | | |
|---|---|---|---|
| 3,939,654 | 2/1976 | Creps | 123/440 |
| 4,132,200 | 1/1979 | Asano et al. | 123/440 |
| 4,153,023 | 5/1979 | Asano et al. | 123/440 |
| 4,155,335 | 5/1979 | Hosaka et al. | 123/440 |
| 4,167,925 | 9/1979 | Hosaka et al. | 123/440 |
| 4,183,335 | 1/1980 | Asano et al. | 123/440 |
| 4,208,990 | 6/1980 | Asano | 123/440 |
| 4,208,993 | 6/1980 | Peter | 123/440 |
| 4,214,563 | 7/1980 | Hosaka | 123/440 |
| 4,279,230 | 7/1981 | Bauer et al. | 123/440 |
| 4,338,990 | 7/1982 | Dilger et al. | 123/440 |

*Primary Examiner*—Raymond A. Nelli

*Attorney, Agent, or Firm*—Edwin E. Greigg

[57] ABSTRACT

A regulating device is described for regulating or adjusting the composition of the operating mixture of an internal combustion engine. When the engine or exhaust gas probe is still cold, the composition of the fuel-air mixture is controlled in an open-loop manner, and upon the attainment of a minimum operating temperature, the closed-loop regulating device for influencing the fuel-air mixture is activated. The activation of the regulating device is effected, when the engine is being operated under a load, after the attainment of a first, low temperature value; during engine idling, this is effected after the attainment of a second, higher temperature value. Via the throttle valve, a switchover is effected between two threshold values of a threshold switch.

3 Claims, 2 Drawing Figures

TEMPERATURE RESPONSIVE OPEN/CLOSED LOOP SWITCHING FOR LAMBDA CONTROL

CROSS-REFERENCE TO RELATED PRIOR ART

German Offenlegungsschrift No. 23 01 354
German Offenlegungsschrift No. 26 38 119
German Offenlegungsschrift No. 27 07 383

BACKGROUND OF THE INVENTION

The present invention relates to an improved adjustment and regulation system so that when the engine is still cold, air-fuel feed is controlled by an open-loop system and when a minimum operating temperature is attained, a closed-loop control regulating device is used.

In a known device of this kind (German Offenlegungsschrift No. 23 01 354), a monitoring device which monitors the functioning of the oxygen measuring probe used as an exhaust gas probe; if the probe is not functioning, the monitoring device deactivates the regulating device. Furthermore, a supplementary contact in the known device affords the opportunity of activating the regulating device only upon the attainment of a specified operating temperature of the internal combustion engine.

In oxygen measuring probes which operate on the principle of ion conduction by means of a solid electrolyte and whose output signals exhibit a voltage jump at an air number of $\lambda=1$, the function is greatly dependent on temperature. Only after a minimum temperature has been attained does the measuring probe emit a voltage signal which is sufficiently rapid for the purposes of the subsequent regulating means.

There are known devices using an oxygen measuring probe of this kind which detect the earliest-possible operational readiness of the measuring probe and then activate or deactivate the regulating device for the fuel-air mixture of the engine accordingly (German Offenlegungsschrift No. 27 07 383). The early activation of the regulating device which is sought in this known device has the disadvantage, however, of not having the oxygen measuring probe react quickly enough to changes in the mixture composition. During idling, this condition can cause "bucking" or roughness on the part of the engine.

OBJECT AND SUMMARY OF THE INVENTION

The regulating device according to the invention has the advantage that activation of the regulating device during engine idling is possible only after a specific engine operating temperature, at which engine roughness does not occur, has been exceeded.

As a result of the characteristics disclosed hereinafter, advantageous modifications of and improvements to the apparatus disclosed are possible.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
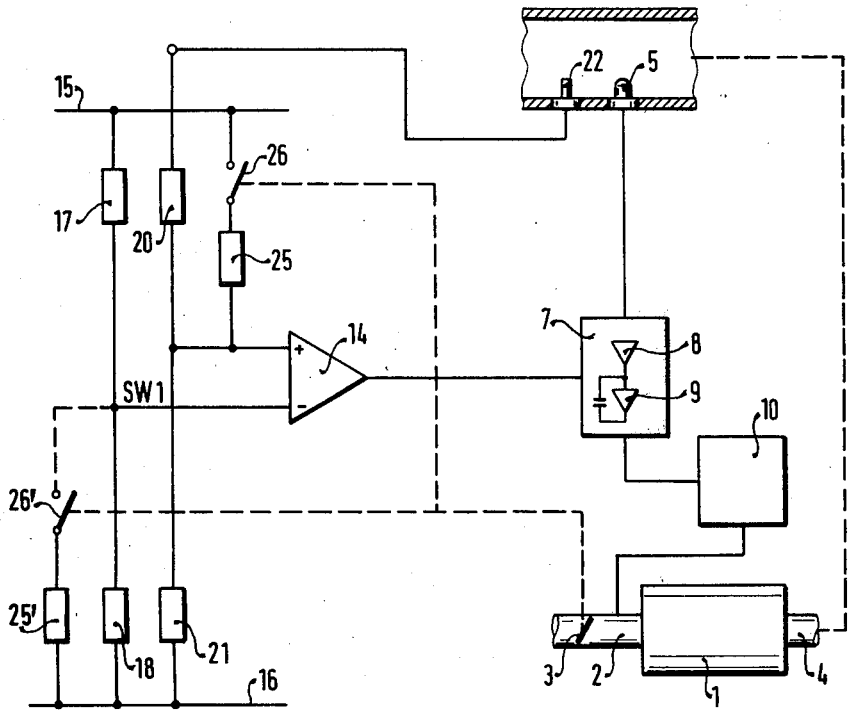
FIG. 1 is a fundamental schematic representation of a first exemplary embodiment of a best mode and preferred embodiment of the invention.

FIG. 1 shows in schematic form an internal combustion engine 1 having an intake system 2, in which a conventional throttle valve 3 is provided for regulating the load, and an exhaust gas system 4. An oxygen measuring probe 5 of known design is inserted into a wall of the exhaust gas system 4. The measuring probe 5 functions on the principle of oxygen-ion conduction in a solid electrolyte body and it has an output signal which exhibits a voltage jump at an air number $\lambda=1$. The location of the jump is used in a known manner for regulating the fuel-air ratio of the fuel-air mixture delivered to the engine. A regulating device switched subsequent to the oxygen measuring probe is of known design, such as that described in German Offenlegungsschrift No. 26 38 119. The regulating device 7 contains, among other elements, a threshold switch 8 and a subsequent integrator 9, which triggers an adjusting device 10 by means of which the fuel or air component of the operating mixture delivered to the engine can be varied. The initial adjustment of the operating mixture is controlled in a conventional manner at first in accordance with operating parameters of the engine such as the quantity of aspirated air. The fuel-air mixture thus established is then corrected, if necessary, via the regulating device 7. To this end, it is possible to vary either the quantities of supplementary air or supplementary fuel, or the control times of fuel injection valves.

Figure 2:
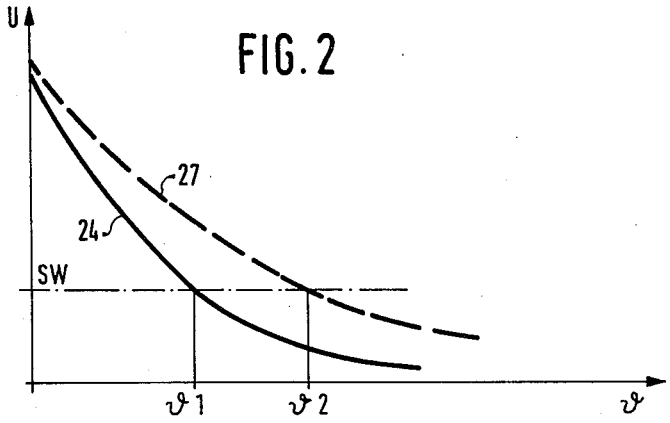
FIG. 2 is a diagram illustrating the mode of operation of the apparatus according to the invention.

Also shown in FIG. 1 is a threshold switch represented by an operational amplifier 14. In the illustrated exemplary embodiment, the inverting input of the operational amplifier is connected with a voltage divider, comprising the resistors 17 and 18, located between the electric current supply lines 15 and 16. The non-inverting input is connected with a voltage divider comprising two resistors 20 and 21, of which resistor 21 is connected with the ground line 16 and the other resistor 20 is connected with a temperature-signal transducer 22, which either directly or indirectly measures the temperature of the engine or of the oxygen sensor. The temperature-signal transducer in the exemplary embodiment emits a voltage which drops as the temperature increases, as is illustrated in FIG. 2 by the curve 24.

Also connected to the non-inverting input of the operational amplifier 14, which works as a threshold switch via a resistor 25 and a switch 26, is the positive potential of the electric current supply line 15. The switch 26 is controlled by the position of the throttle valve 3 in such a manner that when the throttle valve is closed it is also closed. The switch 26 can be either a direct contact on the throttle valve shaft or a semiconductor element which is controlled by an appropriate control voltage.

In an alternative embodiment of FIG. 1, which is indicated by broken lines, the middle pickup SW1 between the resistors 17 and 18 of the reference voltage dividers can also be connected to ground via a switch 26' and a resistor 25'. Switch 26' is also controlled by the position of the throttle valve 3.

The device functions as follows:

As long as the throttle valve 3 is closed, a preliminary voltage is present at the non-inverting input of the operational amplifier 14 which gradually drops with an increasing temperature that is, with the voltage at the resistor 20 which is dropping. Upon attaining the voltage initially established via the voltage divider comprising the resistors 17 and 18, the operational amplifier 14 switches over and emits an "L" (Low) signal to the regulating device 7. As a result, a suitable device puts the regulating device 7 into a status where it can perform its regulating function. Previously, with a signal "H" (high) present at the output of the threshold switch, the regulating device was deactivated, so that the engine was supplied only with the fuel and air quantities which had been metered by the open-loop control device. The voltage present at the non-inverting input takes a course described by curve 27 in FIG. 2. In the diagram, the voltage emitted by the temperature transducer which is present at the non-inverting input is plotted over the temperature. The line SW in FIG. 2 illustrates the status of the threshold value present at the inverting input.

If the switch 26 is opened in the partial-load position of the throttle valve 3, however, then the voltage at the non-inverting input of the operational amplifier 14 is that illustrated by curve 24 in FIG. 2. Thus the threshold value SW is already attained at a low operating temperature, and the regulating device is switched over from open-loop to closed-loop control.

If instead of the switch 26 in the connection between the non-inverting input of the threshold switch and the voltage supply line 15, the switch 26' is connected between the negative voltage supply line 16 or between ground and the pickup point SW1, then instead of a shift in the curve 24 of FIG. 2 the result is a shift in the curve SW. The result attained is equally efficacious. By reverse logic, instead of the switching of the operational amplifier, the temperature signal may be carried to the inverting input.

With the described device, two switching points of the threshold switch are established in an advantageous manner, affording the opportunity of switching over from one to the other in accordance with the throttle valve position. When the throttle valve is closed (that is, when the engine is idling), a switchover of the threshold switch occurs only at a higher temperature, in which it is assured that the subsequent regulating device cannot cause engine roughness during idling. If the conditions of idling are not present, then the regulating device can be activated by the device according to the invention at a lower temperature point.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A lambda regulating device for the composition of the operating mixture being combusted in an internal combustion engine comprising, an exhaust gas probe producing an output signal and being applied to said lambda regulating device for correcting the operating mixture composition, a means supplying a temperature signal a means for deactivating and activating said lambda regulating device in accordance with the evaluation of said temperature signal, a threshold switch having two inputs connected to said lambda regulating device, one of said inputs being responsive to said temperature signal, a threshold value generating means responsive to said threshold switch, and a switchover means controllable in accordance with a position of a throttle valve of said engine for switching said threshold switch between a low and a high value with respect to said temperature signal, said switchover means being reversible up to the point where the higher value has been attained.

2. A regulating device as defined by claim 1, wherein in the idling position of the throttle valve, a first switching input takes effect, and in the remaining operational range a second switching input takes effect.

3. A regulating device as defined by claim 2, wherein said throttle valve in the idling position, actuates said switchover means, whereby one of said inputs of said threshold switch is capable of being additionally connected with a predetermined voltage potential.

* * * * *